US010676333B2

(12) United States Patent
De Jong

(10) Patent No.: US 10,676,333 B2
(45) Date of Patent: Jun. 9, 2020

(54) MOBILE LIFTING COLUMN WITH DISPLACEMENT SYSTEM FOR LIFTING A VEHICLE, AND LIFTING SYSTEM AND METHOD THEREFOR

(71) Applicant: Stertil B.V., Kootstertille (NL)

(72) Inventor: Jurjen Jan De Jong, Buitenpost (NL)

(73) Assignee: Stertil B.V., Kootstertille (NL)

( * ) Notice: Subject to any disclaimer, the term of this patent is extended or adjusted under 35 U.S.C. 154(b) by 141 days.

(21) Appl. No.: 15/848,319

(22) Filed: Dec. 20, 2017

(65) Prior Publication Data

US 2018/0186611 A1 Jul. 5, 2018

(30) Foreign Application Priority Data

Jan. 4, 2017 (NL) ..... 2018119

(51) Int. Cl.

| | |
|---|---|
| ***B66F 5/04*** | (2006.01) |
| ***B66F 7/28*** | (2006.01) |
| ***B66F 3/46*** | (2006.01) |
| ***B66F 7/06*** | (2006.01) |
| ***B66F 7/04*** | (2006.01) |

(52) U.S. Cl.

CPC ..... *B66F 5/04* (2013.01); *B66F 3/46* (2013.01); *B66F 7/04* (2013.01); *B66F 7/0625* (2013.01); *B66F 7/28* (2013.01)

(58) Field of Classification Search

CPC ..... B66F 5/04; B66F 3/46; B66F 7/0625

See application file for complete search history.

(56) References Cited

U.S. PATENT DOCUMENTS

| | | | | |
|---|---|---|---|---|
| 3,286,985 | A * | 11/1966 | Edera | B66F 3/42 254/2 B |
| 5,236,065 | A | 8/1993 | Isogai | |
| 5,911,408 | A | 6/1999 | Berends et al. | |
| 9,803,664 | B2 * | 10/2017 | Petersen | F15B 15/2884 |
| 2006/0182563 | A1 | 8/2006 | De Jong et al. | |

(Continued)

FOREIGN PATENT DOCUMENTS

| | | |
|---|---|---|
| AU | 8900082 A | 4/1983 |
| FR | 2714899 A1 | 7/1995 |

OTHER PUBLICATIONS

FR 2714899 A1 (Sefac Equipement). Published Jul. 13, 1995. English machine translation retrieved Jul. 3, 2019 from Espacenet. (Year: 1995).*

*Primary Examiner* — Jonathan Snelting

(74) *Attorney, Agent, or Firm* — The Webb Law Firm

(57) ABSTRACT

The present invention relates to a mobile lifting column for lifting a vehicle, and system and method therefor. The lifting system according to the invention includes: a frame with a moveable carrier configured for carrying the vehicle; a drive which acts on the carrier and is configured for raising and/or lowering the carrier relative to the frame; a displacement mechanism configured for positioning the lifting column; and a controller configured for controlling movement of the carrier, wherein the displacement mechanism has a displacement frame including a housing, a wheel that can be moved relative to this frame between a displacement and a stationary position, a counter force element, and a steering handle that is operatively coupled to the wheel with a linkage mechanism that is configured for moving the wheel relative to this frame.

17 Claims, 7 Drawing Sheets

(56) References Cited

U.S. PATENT DOCUMENTS

| | | | | |
|---|---|---|---|---|
| 2015/0232309 | A1* | 8/2015 | Jaipaul | B66F 7/04<br>414/800 |
| 2016/0052757 | A1 | 2/2016 | De Jong | |

* cited by examiner

MOBILE LIFTING COLUMN WITH DISPLACEMENT SYSTEM FOR LIFTING A VEHICLE, AND LIFTING SYSTEM AND METHOD THEREFOR

CROSS-REFERENCE TO RELATED APPLICATION

This application claims priority to Dutch Patent Application No. 2018119 filed Jan. 4, 2017, the disclosure of which is hereby incorporated in its entirety by reference.

FIELD

The invention relates to a mobile lifting column for lifting a vehicle such as passenger cars, trucks, busses and other vehicles, and more specifically the invention relates to a wireless mobile lifting column.

BACKGROUND

Lifting columns are known from practice and comprise a frame with a carrier that is connected to a drive for moving the carrier upwards and downwards. In the ascent mode, hydraulic oil is pumped to a cylinder for lifting the carrier with the vehicle. In the descent mode, the carrier with the vehicle is lowered and hydraulic oil returns to the reservoir. Such prior art lifting system is disclosed in U.S. Patent Application Publication No. 2006/0182563, which is incorporated herein by reference.

Mobile lifting columns that are known from practice often comprise a pallet truck mechanism for displacing or positioning the lifting column. A problem associated with such conventional mechanism is that it may unintentionally displace with the lifting column rolling over its wheels while carrying a load. U.S. Pat. No. 5,911,408 of the same applicant discloses the use of a balance connecting a drive and a counter drive, for example including a gas spring. This requires different configurations for different types of lifting columns. This results in a restricted flexibility for generic application of such pallet truck mechanism with different types of lifting columns. In addition, the conventional pallet truck mechanism involves a relatively high number of parts to enable displacement/positioning of the lifting column.

Another problem is the lack of sufficient space when positioning the lifting columns with a conventional pallet truck mechanism. Such conventional mechanisms require sufficient space for manoeuvring the lifting column. This is not always available in a workshop such that positioning the column takes more time and/or may result in damage to the column or its surroundings.

An object of the present invention is to obviate or at least reduce the aforementioned problems associated with positioning/displacing a mobile lifting column.

SUMMARY

This object is achieved with the mobile lifting system for lifting a vehicle, such as a passenger car, truck, bus or other vehicle, with the mobile lifting column comprising:

- a frame with a moveable carrier configured for carrying the vehicle;
- a drive which acts on the carrier and is configured for raising and/or lowering the carrier relative to the frame;
- a displacement mechanism configured for positioning the lifting column; and

- a controller configured for controlling movement of the carrier, wherein the displacement mechanism comprises:

- a displacement frame comprising a housing, and a wheel that is provided at a first end of the housing, wherein the wheel is moveable relative to the frame between a displacement position wherein the lifting column can be displaced and a stationary position wherein the lifting column is in a stationary position;
- a counter force element that is providing in or on the frame; and
- a steering handle that is operatively coupled to the wheel with a linkage mechanism that is configured for moving the wheel relative to the frame, and wherein the steering handle is connected to the displacement frame at a second end of the housing.

The carrier of the lifting column is capable of carrying the vehicle that needs to be lifted. In a presently preferred embodiment the carrier moves upward and/or downward relative to the frame of the lifting column with the use of a drive. The carrier comprises a carrying part that is configured for carrying a vehicle, or at least a part thereof. The carrier further comprises a guiding part that enables a guiding movement relative to the frame of the lifting column. In a presently preferred embodiment, the drive comprises a hydraulic cylinder drive unit that is configured for raising the carrier. This unit comprises a housing, a cylinder with a piston rod that is movable in the housing of the cylinder, and corresponding parts of such hydraulic system. Alternatively, another drive system can be used, for example a pneumatic and/or electrical drive system. In one of the presently preferred embodiments the unit is embodied as an integrated hydraulic cylinder drive unit as disclosed in U.S. Patent Application Publication No. 2016/0052757 which is incorporated herein by reference.

The lifting column further comprises a controller that is configured for controlling the height of the carrier. The controller can be provided at or in the frame of the lifting column and/or may relate to a central controller capable of controlling a number of lifting columns and/or several groups of lifting columns, or any mixture thereof. Preferably, the controller also comprises a display and optionally other user input and output devices to enable communication with the user. The controller is preferably capable of receiving a measurement from one or more sensors or sensor systems that indicate one or more of a height of the carrier, height difference of the carrier, moving speed of the carrier, and information about the control actions directed towards the drive, such as the amount of hydraulic oil sent to the drive for raising or lowering the carrier relative to the frame.

According to the invention the displacement mechanism of the lifting column is configured for positioning/displacing the lifting column and comprises a frame and a moveable wheel. More specifically, the wheel can be moved relative to the frame in a substantial vertical direction between a displacement position and a stationary position. In the stationary position the lifting column rests with its foot and/or other frame part on the ground surface thereby providing a stable configuration for lifting the vehicle. The displacement mechanism further comprises a counter force element that is provided in or on the displacement frame. In its presently preferred embodiment of the invention the counter force element pushes the wheel downward relative to the displacement frame. Preferably, the counter force is such that, in case the mobile lifting column carries a vehicle, the forces acting on the displacement frame are such that the displacement frame moves relative to the wheel against the action of the counter force and moves the displacement frame to its stationary position. This guarantees a safe working environment preventing injuries and/or damage to the column or its surroundings.

Furthermore, the displacement mechanism comprises a steering handle that is operatively coupled to the wheel with a linkage mechanism. The linking mechanism is configured for moving the wheel relative to the frame. This improves ease of positioning or displacing the mobile lifting column. According to the invention the steering handle is connected to the displacement frame at a second end or side of the housing, while the wheel is provided at the first end or side of the housing. More specifically, with the displacement frame having a part extending in a substantially vertical direction, the first end or side of the housing is at or near the bottom side of the displacement frame and the second end or side of the housing is at or near the upper side of the displacement frame. This specific position for the steering handle improves positioning or displacing the column. More specifically, this position reduces the amount of space that is required when positioning/displacing the mobile lifting column of the invention. Furthermore, this reduces the risk of causing damage to the column or its direct surroundings.

As a further effect, the steering handle according to the invention also reduces the risk of an operator hand getting jammed or wedged between the displacement frame and the other parts of the frame of the mobile lifting column. This further improves working with the mobile column of the invention.

Providing the counter force element achieves an effective counter force acting on the wheel of the mobile lifting column. The element is configured such that, without a load acting on the lifting column, the force is such that the frame of the mobile lifting column can be positioned/displaced. The element is also configured such that, when a load such as a vehicle is carried by the mobile lifting column, this load exceeds the counter force such that the frame of the mobile lifting column rests on the ground surface of the workshop, for example. This achieves a safe working environment by preventing that mobile column rolling away from its position when lifting a vehicle.

In a presently preferred embodiment the counterforce element is a spring element substantially extending along a displacement frame axis between the wheel and the steering handle.

Providing the counter force element as a spring element achieves an effective embodiment of the invention to provide the save working environment.

Preferably, the counter force is adjustable between 1000 and 10000 N, more preferably between 1500 and 7500 N, and most preferably between 2000 and 6000 N. These counterforces appear to be appropriate for providing a mobile lifting column that is easy to handle and displace, and also provides a safe working environment.

Preferably, the counterforce is adjustable. By providing an adjustable counterforce the mobile lifting column is flexible in application with different types of lifting columns. This provides a more generic displacement mechanism that can be applied when lifting different vehicle types, such as trucks or passenger cars. This improves the operational flexibility of the mobile lifting column according to the present invention.

In a presently preferred embodiment the spring element extends with its axis along the axis of the displacement frame. Preferably, the spring element is provided over a substantial part of this axis that preferably connects the wheel and the steering handle. Therefore, in this embodiment the spring element extends between the opposite ends of the housing of the displacement frame. This provides an effective counter force element involving a limited number of parts and is mounted in a (semi-)closed environment. This prevents fouling and malfunctioning of the counter force element. This provides a robust mobile lifting column.

In a further presently preferred embodiment of the invention the linkage mechanism comprises a rod that extends between the wheel at the first end or side of the housing and the handle at the second end or side of the housing, and is furthermore connected to the handle.

Providing a linkage mechanism achieves an effective displacement mechanism. More specifically, by providing the handle at the opposite end of the housing of the displacement mechanism as the wheel, an effective displacement/positioning of the mobile lifting column is made possible. Preferably, the rod acts as axis or shaft of the housing of the displacement mechanism. This provides a robust and stable displacement mechanism.

Preferably, the handle is pivotally connected to the housing at a hinge. The displacement mechanism further preferably comprises a lever or balance with a linkage mechanism being pivotally connected to the lever or balance. This enables easy handling of the displacement mechanism, more specifically easy moving of the wheel between the displacement position and the stationary position. In a presently preferred embodiment the handle itself acts as lever or balance. This achieves an effective displacement mechanism. In a presently preferred embodiment of the invention, the lifting column further comprises a damping element that is configured for damping the movement of the steering handle when moving the lifting column from a stationary position wherein the lifting column is in a stationary (parking) position to a displacement position wherein the lifting column can be displaced. The damper preferably comprises an oil damper and/or is preferably provided below the handle. This damping element prevents the handle moving upwards too fast with the risk of injuring a user, for example. Preferably, when moving the handle in the other direction the damping element is not functional such that the transfer into the stationary position is not hindered. Alternatively, or in addition thereto, the displacement mechanism comprises an overcenter linkage. Such overcenter linkage is a mechanical stop in the linkage to prevent any "back driving" of such mechanism. The movement of the handle to position the wheel is held by the overcenter mechanism to provide a stable position and thereby a safe working environment.

In a preferred embodiment of the invention the displacement mechanism further comprises a position sensor that is configured for detecting the position of the displacement system.

By providing a position sensor an additional safety measure is provided that detects the actual position of the displacement system, more particularly it detects the position of the wheel relative to the displacement frame. Preferably, the use of this position sensor provides a detection of the actual position in addition to the visual inspection of the position of the handle. This improves the safety when working with the lifting column of the invention.

Preferably, the sensor comprises an induction detector that is provided in or on the housing of the displacement mechanism. Preferably, in such embodiment, the sensor further comprises metal bush or profile that moves with the wheel relative to the housing and the detector when moving the wheel between the displacement and stationary positions. This achieves an effective detection of the actual position of the displacement mechanism. This detection is preferably coupled to the controller of the mobile lifting column such that the actual detection may block and/or authorize further operation with the mobile lifting column. This contributes to providing a safe working environment.

In a further preferred embodiment of the invention the frame of the lifting column comprises a foot having a tapering part with an additional running wheel at or near the front of the foot of the frame.

By providing the foot with a tapering part the overall stability of the lifting device is improved. The tapering part has the highest thickness or height close to the mast of the frame. This improves the overall strength and stability without increasing the amount of material that is required for stable positioning of the lifting device. This is particularly advantageous for mobile lifting columns.

Preferably, the frame of the lifting column comprises a modular cartridge containing an additional running wheel at or near the front of a foot of the frame. This provides an effective means for positioning or displacing lifting columns, in particular mobile lifting columns. In addition, the cartridge enables effective assembly and maintenance of the running wheel.

The present invention also relates to a lifting system comprising one or more of the aforementioned mobile lifting columns.

The lifting system provides the same effects and advantages as those stated for the lifting device. The individual lifting devices/columns can be controlled by a central controller of the lifting system, for example.

As an example, a number of mobile lifting columns can be grouped together as a lifting system, preferably so-called wireless lifting column. In an embodiment of such a lifting system according to the invention, when lifting a vehicle, at least two lifting columns are being used. In fact, often four lifting columns are being used. During such lifting operation, the timing of these separate lifting columns, preferably including the moving speed of the carrier that carries (part of) the vehicle when lifting a vehicle, requires synchronization. The control of the lifting system preferably comprises a system controller that synchronizes the height of the separate carriers in the ascent mode using, for example, a measurement signal generated by a height sensor, for example a potentiometer. Of course, other sensors can also be used.

In case one of the carriers has moved too fast in the ascent mode and is too high as compared to the other carriers of the other lifting columns, for example the power supply to this carrier is either directly or indirectly lowered so that the other carriers can catch up, or alternatively, or in addition thereto, the power supply to the other carriers is either directly or indirectly increased so that the other carriers can catch up. In the descent mode, it is also important that the height of the carriers between the several lifting columns is synchronized. Therefore, in case one of these carriers has moved too slowly, for example its power supply is increased in order for this carrier to catch up with the other carriers, or alternatively, the power supply to the other carriers is either directly or indirectly lowered so that the other carriers can catch up.

The present invention also relates to a method for lifting a vehicle with a lifting column or lifting system, the method comprising the steps of:

- providing a lifting column or lifting system according to one of the embodiments of the present invention;
- positioning the lifting column with the displacement mechanism; and
- lifting the vehicle of the drive acting on the carrier.

The method provides the same effects and advantages as those stated for the lifting column and/or lifting system. The individual lifting columns can be controlled by a central controller of the lifting system, for example. This further improves the accuracy and safety of the lifting system.

In a presently preferred embodiment the positioning the lifting column comprises the step of raising or lowering the handle for moving the lifting column between the displacement and stationary positions. This achieves an effective method to move the wheel between the different positions. As a further effect, this provides an effective visual indication for an operator to detect the position of the lifting column.

The method provides the same effects and advantages as those stated for the lifting system. The lifting system may comprise a number of mobile lifting columns acting as lifting system, for example. The individual lifting devices or lifting columns can be controlled by a central controller of the lifting system, for example. This further improves the accuracy and safety of the lifting system.

BRIEF DESCRIPTION OF THE DRAWINGS

Exemplary embodiments of a lifting system and/or the method according to the present invention are described here below on the basis of a non-limitative exemplary embodiment therefor shown in the accompanying drawings, wherein.

DETAILED DESCRIPTION

The following description is merely exemplary in nature and is in no way intended to limit the invention, its application, or uses. While the disclosure is described as having exemplary attributes and applications, the present disclosure can be further modified. This application is therefore intended to cover any variations, uses, or adaptations of the disclosure using its general principles. Further, this application is intended to cover such departures from the present disclosure as come within known or customary practice of those skilled in the art to which this disclosure pertains and which fall within the limits of the appended claims. Accordingly, the following description of certain embodiments and examples should be considered merely exemplary and not in any way limiting.

The lift control system of the present invention is suitable for use with lift systems comprising any number of lifting devices that require height control columns, including systems having one, two, four or another number of columns. The columns may achieve lifting and lowering capability by any means known to those of skill in the art, including hydraulically, electrically, mechanically, and electromechanically. Lift systems compatible with the present lift control system may involve wired and/or wireless communication. With reference to the figures, like element numbers refer to the same element between drawings.

Figure 1:
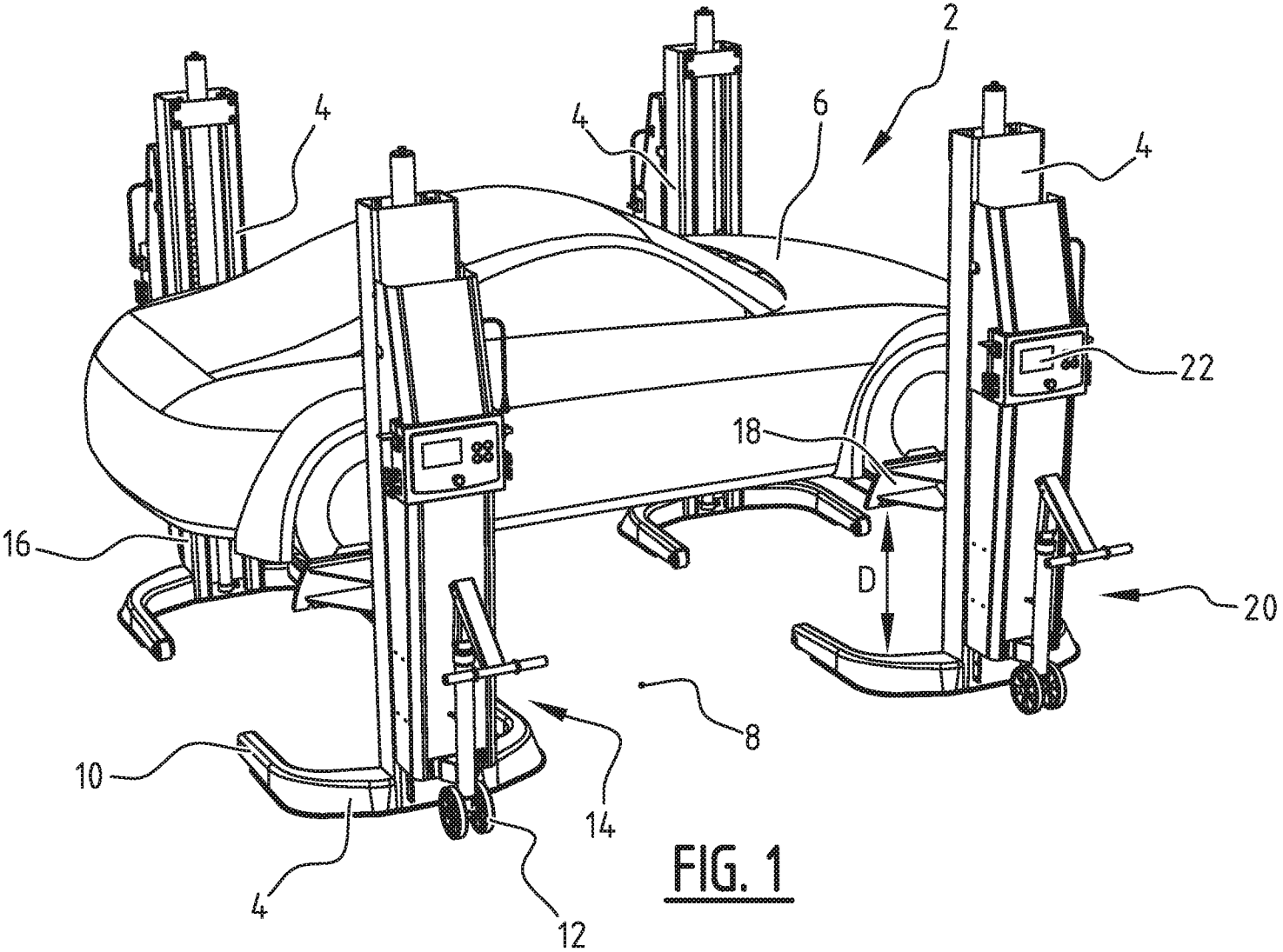
FIG. 1 shows a schematic overview of a vehicle lifted by lifting columns for a lifting system according to the invention.
Figure 2:
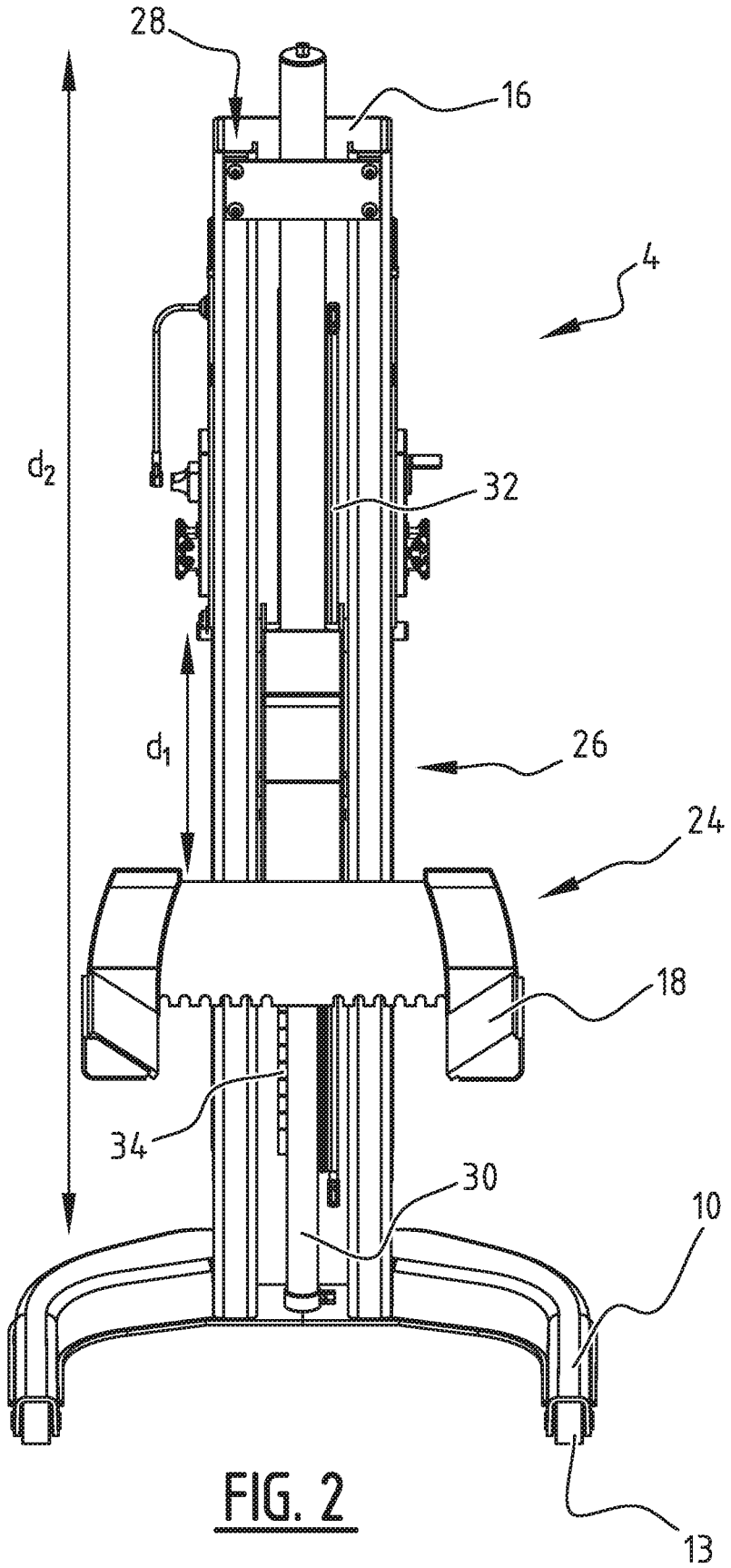
FIG. 2 shows a mobile lifting column of the type shown in FIG. 1 with a displacement system.

System 2 for efficient lifting and lowering load 6 (FIG. 1) comprises four wireless mobile lifting columns 4. Lifting columns 4 lift passenger car 6 from ground 8. In the illustrated embodiment lifting columns 4 are connected to each other and/or a control system by wireless communication means or alternatively by cables. Lifting columns 4 comprise foot 10 which can travel on running wheels 12 over ground surface 8 of for instance a floor of a garage or workshop. In the forks of foot 10 is provided an additional running wheel 13 (FIG. 2). Running wheel 12 is part of pallet truck mechanism 14 enabling easy manoeuvring of lifting column 4. Lifting column 4 furthermore comprises mast 16. Carrier 18 is moveable upward and downward along mast 16. Optionally, adapters can be used to adjust carrier 18 to specific wheel dimensions. Carrier 18 is driven by motor/drive system 20 that is preferably provided in a housing of lifting column 4. System 20 is supplied with power from the electrical grid or by a battery that is provided on lifting column 4 in the same housing as system 20, or alternatively on foot 10 (not shown), for example. Lifting column 4 is provided with control panel 22 to allow the user of system 2 to control the system, for example by setting the speed for carrier 18. In one embodiment, the motor of system 20 is a 3-phase low voltage motor controlled by a separate controller. In another embodiment, the motor of system 20 is a 3-phase low voltage motor with integrated controller. Such motor with integrated controller can also be used in combination with conventional lifting devices with conventional height measurement systems.

Each of the lifting columns has at least one ascent mode and one descent mode, and is under the influence of integrated controller with control panel 22. Controller 22 can be designed for each lifting column 4 individually, or for the lifting columns 4 together. A pressure or load sensor may be used for monitoring, control and indication of the correct positioning of the load that is lifted with lifting system 2.

Carrier 18 (FIG. 2) comprises carrying part 24 and guiding part 26. Guiding part 26 extends over length $d_1$ along guide rail 28 in a substantial vertical direction. Guide rail 28 is provided with cylinder 30. Guide rail 28 extends over length $d_2$ along mast 16. It is noted that this length $d_2$ is mostly related to the length or height of cylinder 30. Mast 16 also houses locking system 32 and locking rail 34. In the illustrated embodiment locking rail 34 extends over a substantial part of the length or height of mast 16.

Figure 3:
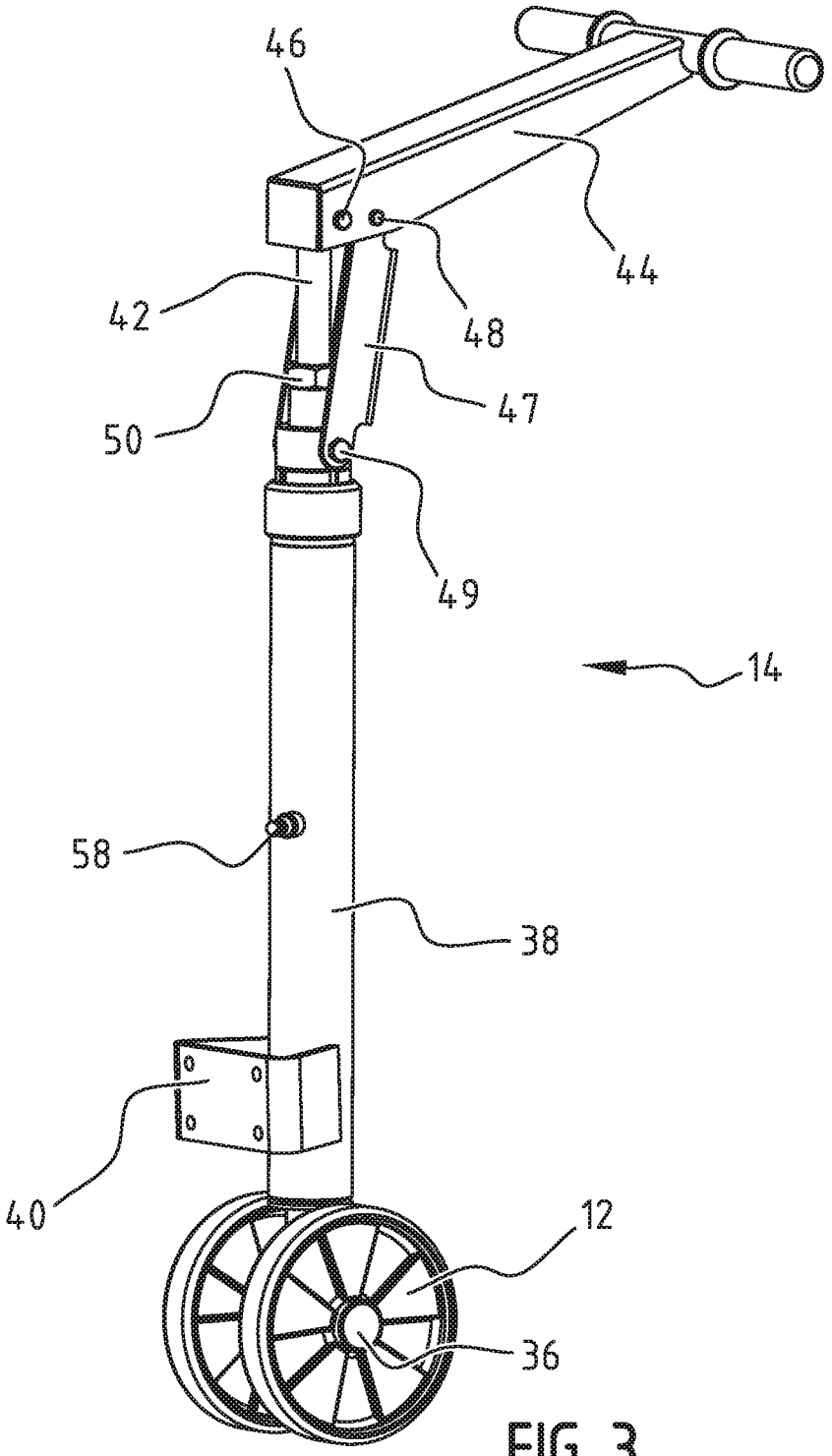
FIGS. 3 and 4 show details of the displacement system in the displacement and stationary positions, respectively.
Figure 4:
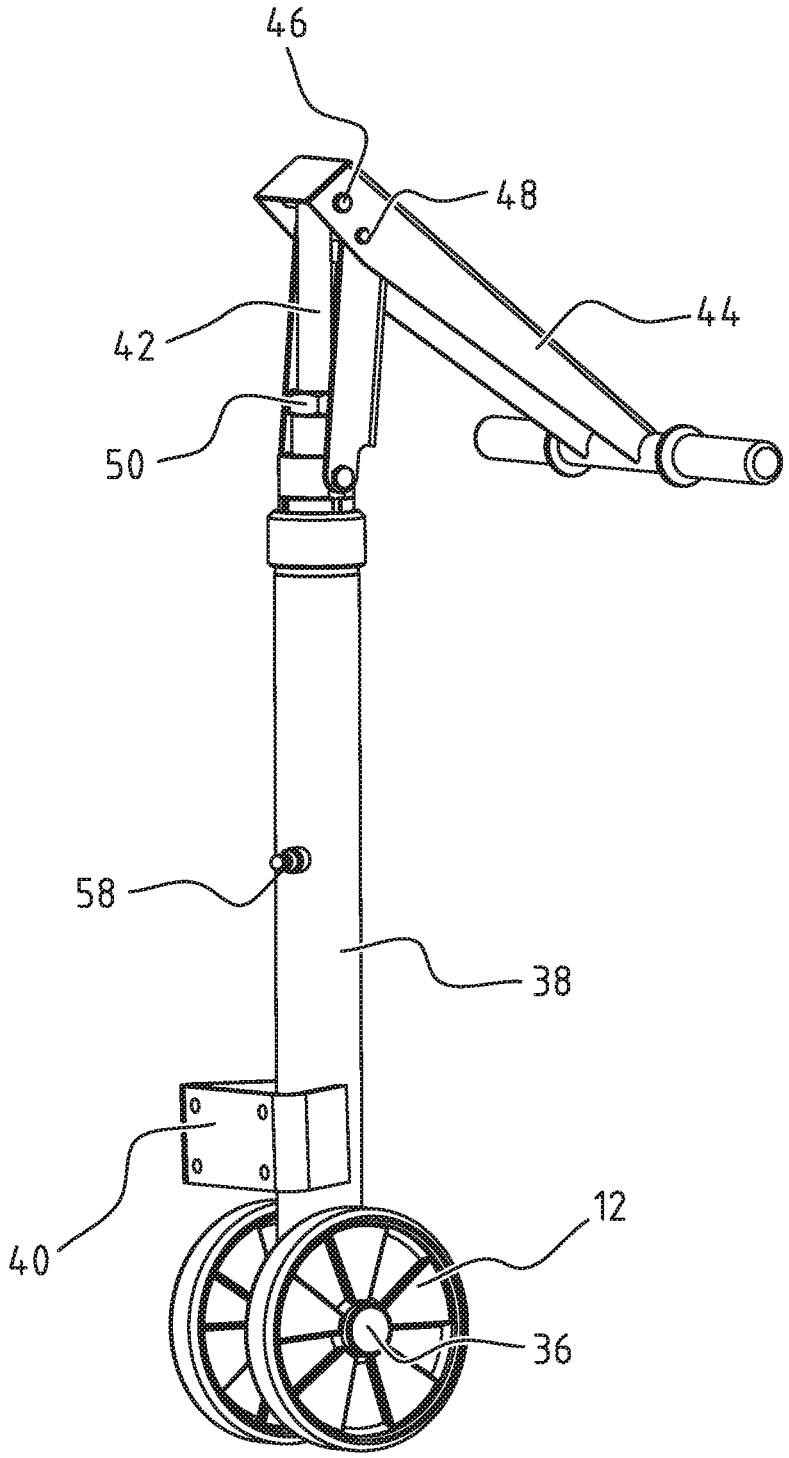
Figure 5:
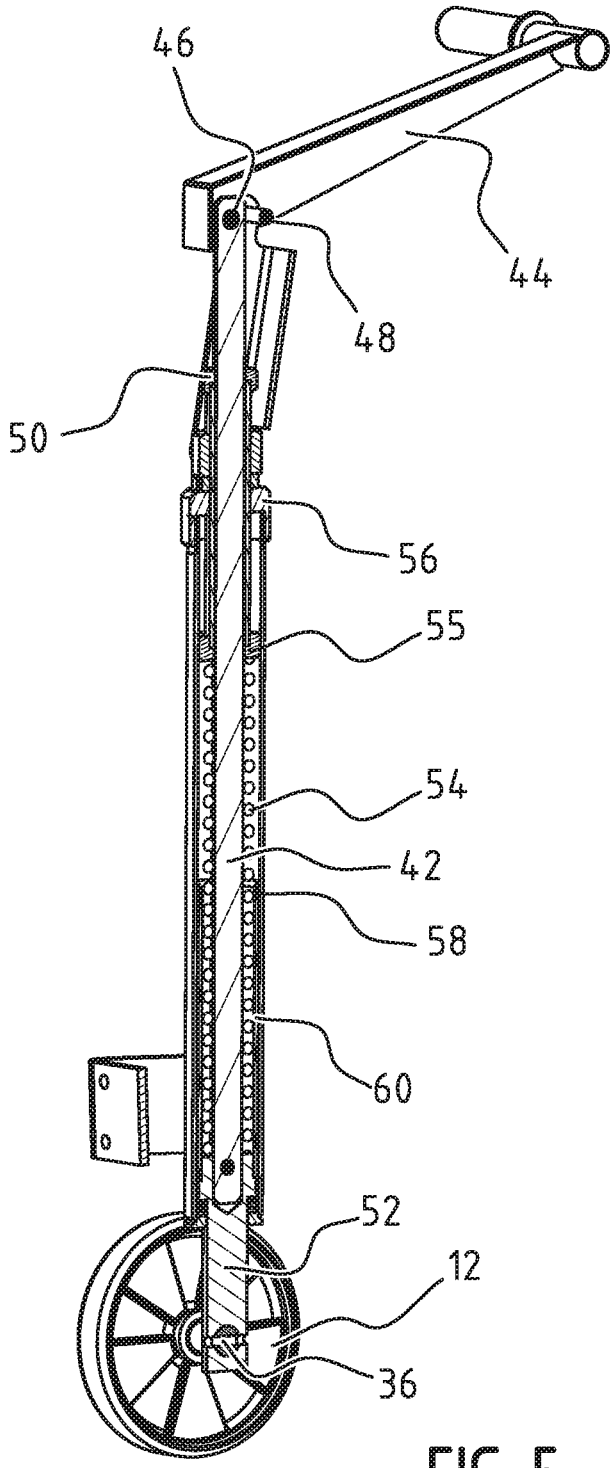
FIG. 5 shows details of the displacement system of FIGS. 3 and 4.

Pallet truck mechanism 14 comprises wheel 12 that is capable of rotating around shaft 36 (FIGS. 3-5). Wheel 12 is connected to displacement housing 38. Connecting block 40 is configured for connecting displacement system 14 to column 4. Rod or shaft 42 extends through housing 38 between wheel 12 and steering handle 44. Handle 44 is pivotally connected to rod 42 at hinge 46. Connector 47 connects steering handle 44 at hinge 48 and connects to rod 42 at hinge 49.

Attached to rod or shaft 42 is adjustment screw 50 (FIGS. 3 and 5). In the illustrated embodiment adjustment screw 50 enables adjustment of the counter force. Connecting rod 52 is connected to shaft 36 of wheel 12 and to rod 42. Connecting rod 52 extends along rod 42, optionally moving with a separate metal bush 60. In the illustrated embodiment spring 54 is provided between rod 42 and connecting rod 52 or bush 60. Adjustment screw 50 enables setting the counter force that is achieved by spring 54 by positioning piston like element 55 relative to spring 54 with screw 50. Stop 56 prevents fouling of spring 54, for example. Sensor 58 is configured for detecting the position of bush or profile 60. This provides a measure for the actual position of displacement system 14.

Figure 6:
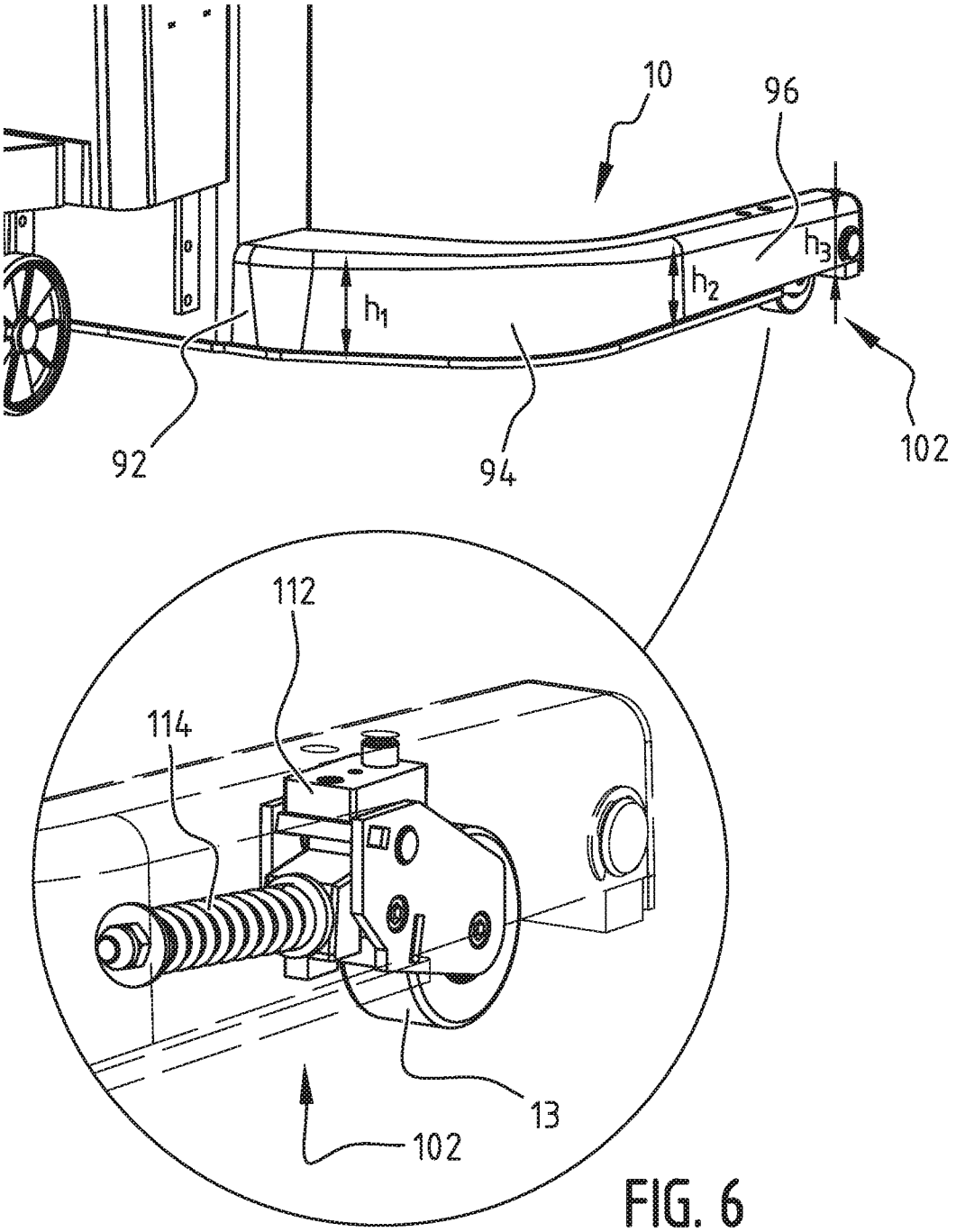
FIG. 6 shows the foot of the lifting column with modular cartridge.

Foot 10 of lifting column 4 (FIG. 6) comprises connecting part 92 having height $h_1$, curve part 94 with height $h_2$ and front part 96 having height $h_3$, with decreasing height from $h_1$ to $h_3$. This provides maximum strength at connecting part 92 and maximum space for manoeuvring at part 96.

Front running wheel or additional wheel 13 is provided in cartridge 102 that is located in front part 96 of foot 10. Cartridge 102 (detail of FIG. 6) comprises frame 112 and spring element 114. Cartridge 102 is designed that it may be replaced as a whole, including additional wheel 13.

Figure 7:
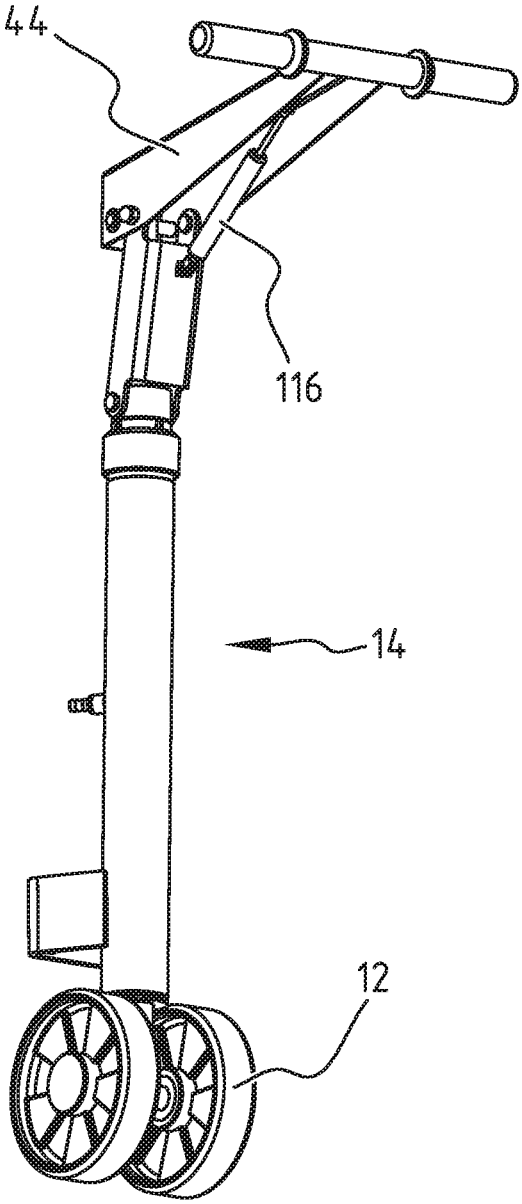
FIG. 7 shows an embodiment of a lifting column with a damping element.

Optionally, damping element 116 (FIG. 7) is provided below steering handle 44. In the illustrated embodiment damping element 116 comprises an oil damper that damps the movement of handle 44 from the stationary to the displacement position. When moving handle 44 from the displacement to the stationary position damping element 116 preferably has no substantial effect. Damping element 116 is optionally applied in all illustrated and/or described embodiments.

When positioning lifting column 4, displacement system 14 is in the displacement position (FIG. 3) wherein mobile lifting column 4 can be moved relative to passenger car 6 and/or another lifting column 4. When lifting column 4 has reached its desired position, steering handle 44 is moved downwards, with the overcenter linkage, to the stationary position (FIG. 4). In this stationary position, lifting column 4 is ready for a lifting operation wherein foot 10 rests on ground surface 8 of a carriage or workshop floor.

When lifting car 6 a number of mobile lifting columns 4 are positioned around vehicle 6. When the lifting operation is approved carriers 18 start moving along masts 16. As soon as the desired height D of carriers 18 above ground surface 8 is reached carriers 18 are stopped.

In a situation wherein lifting column 4 is unintentionally in a displacement position (FIG. 3), while the lifting operation with passenger car 6 is started, its load will exceed the counter force of spring 54. This forces displacement mechanism 14 to move from the displacement position to the stationary position, thereby providing a safer environment. Optionally, sensor 58 detects that displacement mechanism 14 is in the wrong position, thereby blocking operation of lifting column 4.

After the lifting operation has ended, displacement mechanism 14 can be brought from the stationary position to the displacing position by moving steering handle 44 in upwards direction. This enables moving lifting column 4 to another position. As a result, the steering handle 44 is configured for moving the wheel 12 relative to the frame 16 and to steer the entire mobile lifting column 4.

The present invention is by no means limited to the above described preferred embodiments. The rights sought are defined by the following claims within the scope of which many modifications can be envisaged. For example, the present invention can be applied to the (wireless) lifting columns illustrated in FIG. 1. Alternatively the invention can also be applied to other types of lifting columns and lifting systems.

What is claimed is:

1. A mobile lifting column for lifting a vehicle, the lifting column comprising:

a frame with a moveable carrier configured for carrying the vehicle;

a drive which acts on the carrier and is configured for raising and/or lowering the carrier relative to the frame;

a displacement mechanism configured for positioning the lifting column; and a controller configured for controlling movement of the carrier, wherein the displacement mechanism comprises:

a displacement frame comprising a housing, and a wheel that is provided at a first end of the housing, wherein the wheel is moveable vertically relative to the frame between a displacement position wherein the lifting column can be displaced and a stationary position wherein the lifting column is in a stationary position;

a counter force element that is providing in or on the frame, wherein a counter force exerted by the counter force element is adjustable; and a steering handle that is operatively coupled to the wheel with a linkage mechanism that is configured for moving the wheel relative to the frame, and wherein the steering handle is connected to the displacement frame at a second end of the housing and is used to steer the entire mobile lifting column, wherein the linkage mechanism comprises a rod that extends between the wheel at the first end of the housing and the handle at the second end of the housing, and is connected to the handle, and wherein the handle is pivotally connected to the housing at a hinge and the displacement mechanism comprises a lever or balance with the linkage mechanism being pivotally connected to the lever or balance.

2. The lifting column according to claim 1, wherein the counter force element is a spring element substantially extending along a displacement frame axis between the wheel and the steering handle.

3. The lifting column according to claim 2, further comprising a position sensor that is configured for detecting the position of the displacement mechanism.

4. The lifting column according to claim 2, wherein the frame comprises a foot having a tapering part with an additional running wheel at or near a front of the foot of the frame.

5. The lifting column according to claim 1, wherein the counter force is adjustable between 1000 and 10000 N.

6. The lifting column according to claim 1, wherein the handle acts as the lever or balance.

7. The lifting column according to claim 6, wherein the displacement mechanism comprises an overcenter linkage.

8. The lifting column according to claim 1, further comprising a position sensor that is configured for detecting the position of the displacement mechanism.

9. The lifting column according to claim 8, wherein the position sensor comprises an induction detector that is provided in or on the housing.

10. The lifting column according to claim 9, wherein the position sensor further comprises a metal bush that moves with the wheel relative to the housing and the detector when moving the wheel between the displacement and stationary positions.

11. The lifting column according to claim 1, wherein the frame comprises a foot having a tapering part with an additional running wheel at or near a front of the foot of the frame.

12. The lifting column according to claim 1, further comprising a modular cartridge comprising an additional running wheel at or near a front of a foot of the frame.

13. The lifting column according to claim 1, further comprising a damping element configured for damping movement of the steering handle when moving the lifting column from a stationary position wherein the lifting column is in a stationary position to a displacement position wherein the lifting column can be displaced.

14. A lifting system comprising at least one group of two or more lifting columns according to claim 1.

15. The lifting system according to claim 14, wherein the counter force element is a spring element substantially extending along a displacement frame axis between the wheel and the steering handle.

16. A method for lifting a vehicle with a lifting column or lifting system, the method comprising the steps of:

providing at least one lifting column according to claim 1;

positioning the lifting column with the displacement mechanism; and lifting the vehicle with the drive acting on the carrier.

17. The method according to claim 16, wherein positioning the lifting column comprises raising or lowering the handle for moving the wheel between the displacement and stationary positions.

* * * * *